US010573952B2

(12) United States Patent
Shukutani et al.

(10) Patent No.: US 10,573,952 B2
(45) Date of Patent: Feb. 25, 2020

(54) ANTENNA DEVICE

(71) Applicant: FUJITSU TEN LIMITED, Kobe-shi, Hyogo (JP)

(72) Inventors: Masashi Shukutani, Kobe (JP); Norio Imada, Kobe (JP); Haruhiko Kondo, Kobe (JP)

(73) Assignee: FUJITSU TEN LIMITED, Kobe (JP)

( * ) Notice: Subject to any disclaimer, the term of this patent is extended or adjusted under 35 U.S.C. 154(b) by 130 days.

(21) Appl. No.: 15/673,566

(22) Filed: Aug. 10, 2017

(65) Prior Publication Data

US 2018/0062253 A1 Mar. 1, 2018

(30) Foreign Application Priority Data

Aug. 30, 2016 (JP) ..... 2016-168365

(51) Int. Cl.

| | |
|---|---|
| ***H01Q 1/12*** | (2006.01) |
| ***H01Q 9/30*** | (2006.01) |
| ***H01Q 7/00*** | (2006.01) |
| ***H01Q 1/32*** | (2006.01) |
| ***H01Q 21/28*** | (2006.01) |

(52) U.S. Cl.

CPC ..... *H01Q 1/1271* (2013.01); *H01Q 1/3291* (2013.01); *H01Q 7/00* (2013.01); *H01Q 9/30* (2013.01); *H01Q 21/28* (2013.01)

(58) Field of Classification Search

CPC ... H01Q 1/1271; H01Q 1/1285; H01Q 1/3291
See application file for complete search history.

(56) References Cited

U.S. PATENT DOCUMENTS

2007/0001915 A1* 1/2007 Kono ..... H01Q 1/1271 343/713

FOREIGN PATENT DOCUMENTS

| | | | |
|---|---|---|---|
| JP | 2009-267992 | A | 11/2009 |
| JP | 2014-110626 | A | 6/2014 |
| JP | 2016-111562 | A | 6/2016 |

* cited by examiner

*Primary Examiner* — Robert Karacsony
(74) *Attorney, Agent, or Firm* — Oliff PLC

(57) ABSTRACT

An antenna device according to an embodiment includes a plurality of plane-shaped antennas that is attached to one or more windows of a vehicle. The plurality of antennas includes a loop antenna and a monopole antenna corresponding to the loop antenna.

10 Claims, 5 Drawing Sheets

ANTENNA DEVICE

CROSS-REFERENCE TO RELATED APPLICATION

This application is based upon and claims the benefit of priority of the prior Japanese Patent Application No. 2016-168365, filed on Aug. 30, 2016, the entire contents of which are incorporated herein by reference.

FIELD

The embodiment discussed herein is directed to an antenna device.

BACKGROUND

Conventionally, there is known an antenna device that receives electric waves by using a plurality of film antennas (plane-shaped antennas) attached to, for example, a front window of a vehicle. When this antenna device receives electric waves of, for example, Digital Television (DTV) and the like, all of the plurality of antennas are constituted of loop antennas (see Japanese Laid-open Patent Publication No. 2009-267992, for example).

However, an attachment area of the above loop antennas is comparatively large, and thus, in a case of an antenna device all the antennas of which are constituted of loop antennas, an attachment area of the loop antennas on a front window becomes large, as a result, there exists a fear that an area for attaching another apparatus such as an on-vehicle camera is not secured. Thus, the conventional technology has room for improvement in reducing the attachment area of the antenna device.

SUMMARY

An antenna device according to an embodiment includes a plurality of plane-shaped antennas that is attached to one or more windows of a vehicle. The plurality of antennas includes a loop antenna and a monopole antenna corresponding to the loop antenna.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENT

Hereinafter, an embodiment of an antenna device will be described in detail with reference to the accompanying drawings. Moreover, the embodiment described below is merely one example, and not intended to limit the present disclosure.

Figure 1:
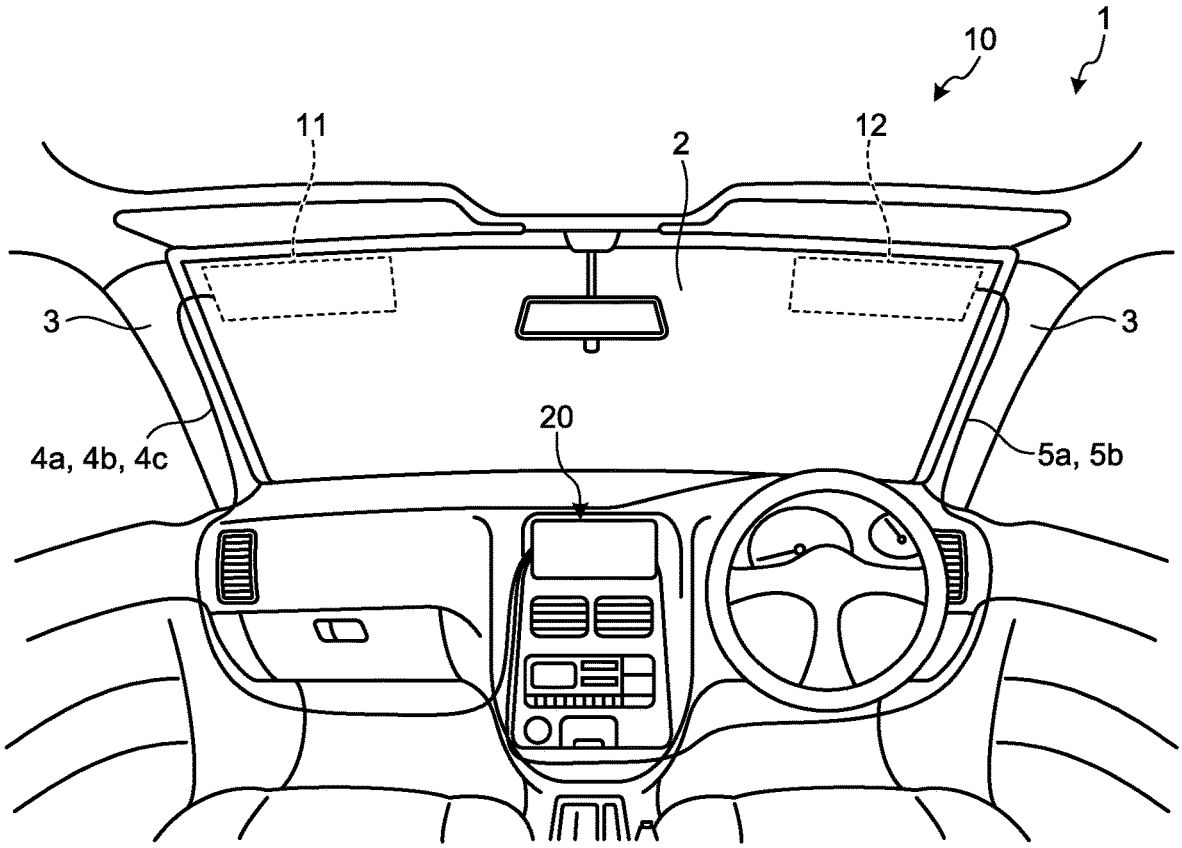
FIG. 1 is a diagram illustrating a configuration of an antenna device according to an embodiment.

First, a configuration of an antenna device according to the embodiment will be explained with reference to FIG. 1. FIG. 1 is a diagram illustrating a configuration of an antenna device 10 according to the embodiment. Moreover, FIG. 1 is schematic view illustrating a forward view of a vehicle 1 from an interior of the vehicle.

Hereinafter, for convenience of explanation, a direction toward a right or a left side of the vehicle 1 in the forward viewing in FIG. 1 is expressed as "right and left direction", and a direction toward a roof or a floorboard of the vehicle 1 is expressed as "up and down direction".

Hereinafter, the antenna device 10 to be attached to a front window 2 of the vehicle 1 will be explained. Alternatively, the antenna device 10 may be an antenna device to be attached to, for example, a rear window or a side window of the vehicle 1.

As illustrated in FIG. 1, the antenna device 10 includes a first integrated antenna 11 and a second integrated antenna 12. Each of the first integrated antenna 11 and the second integrated antenna 12 includes a plurality of antennas to be attached to, for example, the front window 2 of the vehicle 1.

In FIG. 1, regions, to which the first integrated antenna 11 and the second integrated antenna 12 are attached, are indicated by dashed lines. Details of the first integrated antenna 11 and the second integrated antenna 12 will be mentioned later with reference to FIGS. 2A and 2B.

The first integrated antenna 11 and the second integrated antenna 12 are connected with a navigation apparatus 20 so that they can communicate with the navigation apparatus 20 through a plurality of cables 4*a*, 4*b*, 4*c*, 5*a*, and 5*b* that are wired along right and left front pillars 3 of the vehicle 1.

In FIG. 1, for convenience of illustration, the plurality of cables 4*a*, 4*b*, 4*c*, 5*a*, and 5*b* are collectively illustrated by one cable at each of the right and left front pillars 3.

Herein, a conventional antenna device will be explained. In the conventional antenna device, when receiving, for example, electric waves of Digital Television (DTV), all of a plurality of antennas is constituted of loop antennas. Specifically, conventionally, two loop antennas are arranged in each of the two regions of dashed lines illustrated in FIG. 1, and four loop antennas are arranged in all.

Meanwhile, recently, another apparatus increases, such as an on-vehicle camera and an antenna of another communication apparatus that are to be attached to the front window 2. However, a shape of the loop antenna is substantially rectangular, and thus an attachment area on the front window 2 in the right and left direction (direction toward sides of vehicle 1) is comparatively large. Moreover, the two adjacent loop antennas are to be attached at a predetermined interval so as to suppress interference with each other in receiving electric waves.

Thus, in a case of the conventional antenna device all of whose antennas are constituted of loop antennas, the attachment area is comparatively large, and thus there exists a fear that an area for attaching another apparatus is not secured. Thus, in the conventional antenna device has a room for improvement in reducing the attachment area.

Thus, the antenna device 10 according to the embodiment is constituted of a loop antenna and a monopole antenna in a hybrid manner. Specifically, a plurality of antennas, which are included in the first integrated antenna 11 and the second integrated antenna 12, includes a loop antenna and a monopole antenna corresponding to this loop antenna.

In other words, for the antenna device 10 according to the embodiment, a monopole antenna having smaller attachment area than that of a loop antenna is used so as to reduce an attachment area of whole of the antenna device 10. Hereinafter, the first integrated antenna 11 and the second integrated antenna 12 included in the antenna device 10 will be specifically explained.

Figure 2A:
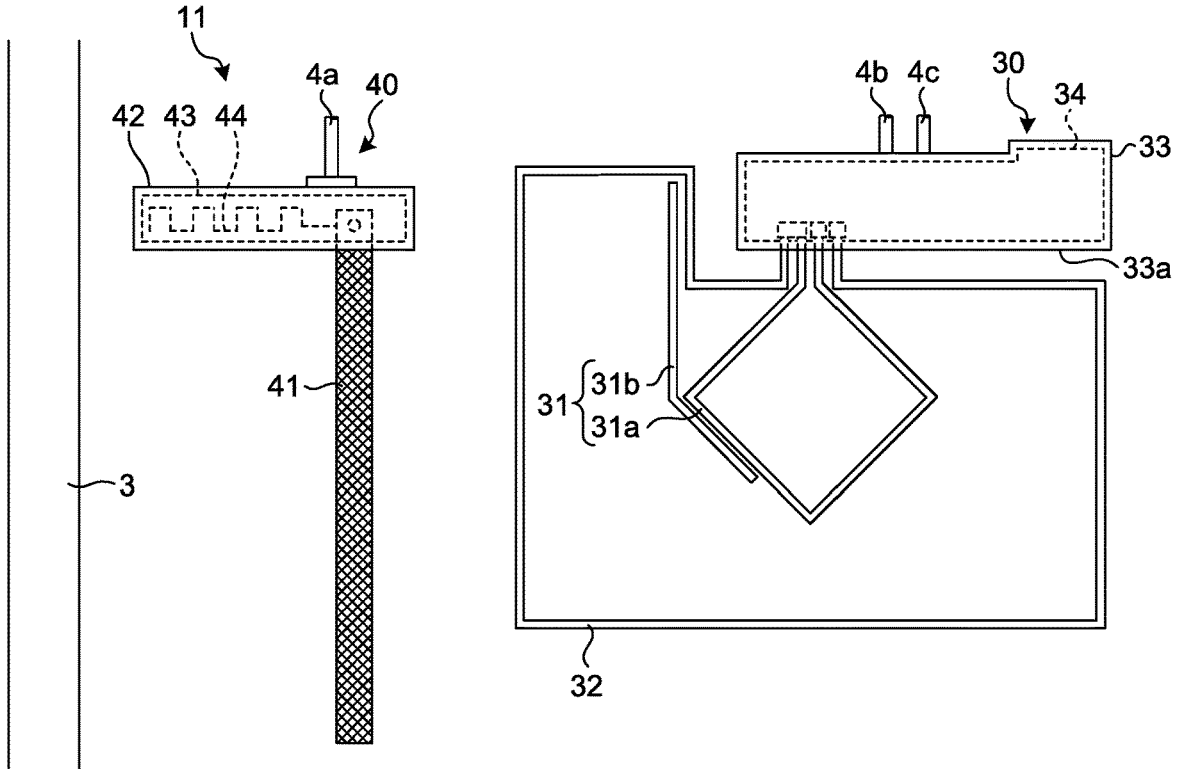
FIG. 2A is a diagram illustrating a configuration of a first integrated antenna attached on a front-passenger-seat side.

The first integrated antenna 11 and the second integrated antenna 12 of dashed lines illustrated in FIG. 1 will be specifically explained with reference to FIGS. 2A and 2B. First, the first integrated antenna 11 will be explained with reference to FIG. 2A. FIG. 2A is a diagram illustrating a configuration of the first integrated antenna 11 attached on a front-passenger-seat side.

As illustrated in FIG. 2A, the first integrated antenna 11 includes a first loop antenna 30 and a first monopole antenna 40. Hereinafter, the first loop antenna 30 and the first monopole antenna 40 corresponding to the first loop antenna 30 may be referred to as "pair".

In other words, in the present embodiment, the antenna device 10 includes, in all, two pairs of a pair of the first loop antenna 30 and the first monopole antenna 40 and a pair of a second loop antenna 50 and a second monopole antenna 60 to be mentioned later (see FIG. 2B).

First, an arrangement relation of the pair of the first loop antenna 30 and the first monopole antenna 40 will be explained. As illustrated in FIG. 2A, the first loop antenna 30 and the first monopole antenna 40 are attached adjacently to the front window 2.

As illustrated in FIG. 2A, the first monopole antenna 40 is attached at a position closer to the front pillar 3 than that in which the first loop antenna 30 is attached, and the first loop antenna 30 is attached at a position closer to an upper-center part of the front window 2 than that in which the first monopole antenna 40 is attached.

Specifically, it is preferable that a distance from a DTV antenna 41 of the first monopole antenna 40 to be mentioned later to the left-side front pillar 3 is approximately ¼ wavelength.

Thus, the front pillar 3 operates as a kind of a reflector so that directionality in the right and left direction of the vehicle 1 is generated, and thus the first monopole antenna 40 can improve a receiving performance of electric waves from the right and left direction of the vehicle 1. The distance from the DTV antenna 41 to the left-side front pillar 3 is not limited to the ¼ wavelength, it is sufficient that the distance causes the front pillar 3 to operate as a reflector.

Herein, a monopole antenna is attached, as an antenna of another apparatus, in an upper-center region (neighborhood of rearview mirror, see FIG. 1) of the front window 2 in many cases.

Thus, the first loop antenna 30 is arranged in a position near the upper-center part of the front window 2, in other words, the first monopole antenna 40 is arranged in a position away from the upper-center part. Thus, interference between the first monopole antenna 40 and a monopole antenna of another communication apparatus can be reduced to the minimum.

There exists no interference between the first loop antenna 30 and a monopole antenna of another apparatus, when another apparatus can be arranged closest to the first loop antenna 30 possible, degrees of freedom in an arrangement of another apparatus in the upper-center region of the front window 2 can be improved.

In FIG. 2A, the first loop antenna 30 is arranged on the upper-center side and the first monopole antenna 40 is arranged on the front pillar 3 side. However, the arrangements of the first loop antenna 30 and the first monopole antenna 40 may be exchanged. In this case, the above operation of the front pillar 3 as a reflector and the above operation of reduction to the minimum in the interference between the first monopole antenna 40 and the monopole antenna of another communication apparatus may be reduced, however, effects of space saving caused by pairing the first loop antenna 30 and the first monopole antenna 40 can be sufficiently obtained.

Next, configurations of the first loop antenna 30 and the first monopole antenna 40 will be explained. First, the first loop antenna 30 will be explained. The first loop antenna 30 includes a Global Positioning System (GPS) antenna 31, a DTV antenna 32, and a connector 33.

The GPS antenna 31 includes an antenna element 31*a* and a parasitic element 31*b*. The GPS antenna 31 and the DTV antenna 32 are formed in a transparent film (not illustrated).

Specifically, the GPS antenna 31 and the DTV antenna 32 are formed by electric-conductor patterns printed on films by using conductive (for example, silver) paste, or conductive wires wired on films, such as very thin cupper wires and silver wires. These electric-conductor patterns or these conductive wires are connected with corresponding terminals of a board 34 included in the connector 33 by soldering and the like.

The antenna element 31*a* is a substantially-rhombus-shaped loop antenna, which includes wire-shaped antenna conductors. The parasitic element 31*b* is constituted of a conductor independent from the antenna element 31*a*, and is arranged near the antenna element 31*a*.

The DTV antenna 32 is an antenna element, and is a loop antenna including a wire-shaped antenna conductor. The DTV antenna 32 is configured so as to circumvent the antenna element 31*a* and the parasitic element 31*b*.

Specifically, the DTV antenna 32 includes an antenna conductor, which is configured downward from a lower surface 33*a* of the connector 33 so as to surround the antenna element 31*a*, and an antenna conductor, which is configured upward from the lower surface 33*a* of the connector 33 so as to circumvent an upper-end part of the parasitic element 31*b*.

In other words, the antenna conductor of the DTV antenna 32 is formed, not into mere rectangle-shaped, so that a part of the antenna conductor protrudes upward from the lower surface 33*a* of the connector 33, and thus needed antenna length is secured.

Thus, in the DTV antenna 32, the antenna conductor is extended in the upward direction, and thus a length of the antenna conductor in the right and left direction can be shortened, so that it is possible to reduce an attachment area in the right and left direction as a result.

The connector 33 has terminals and the board 34 built-in. The terminals electrically connect both ends of the GPS antenna 31 and the DTV antenna 32 with the board 34. The board 34 is a rigid board that is made from, for example, the epoxy resin, ceramic, and the like. In the board 34, for example, an amplifier (not illustrated) is formed, which amplifies electric waves received by the DTV antenna 32.

Next, the first monopole antenna 40 will be explained. The first monopole antenna 40 includes the DTV antenna 41 and a connector 42.

The DTV antenna 41 is a pole-shaped antenna element and includes a thin-wire-shaped conductor that is mesh-shaped. A wire width of the thin-wire-shaped conductor is preferably, for example, 20 μm or less, and more preferably 10 μm or less. An interval between the thin-wire-shaped conductors is preferably, for example, 350 μm or less, and more preferably 300 μm or less.

In other words, because the DTV antenna 41 has transmittivity caused by the mesh shape, when the first monopole antenna 40 is attached to the front window 2, hindrance to the field of forward view of an occupant can be avoided.

The connector 42 is formed into approximately rectangular-parallelepiped-shaped. The connector 42 includes a terminal and a board 43. The terminal electrically connects an end part of the DTV antenna 41 with the board 43.

The board 43 is a rigid board made from, for example, the epoxy resin, ceramic, and the like, and includes an amplifier and a ground part 44. The amplifier is electrically connected with the ground part 44 and the DTV antenna 41 so as to amplify electric waves received by the DTV antenna 41.

The ground part 44 is a ground of the first monopole antenna 40, and is formed so that the ground part 44 has a conductive-wire pattern of a meandering structure. Specifically, the conductive-wire pattern of the ground part 44 is formed into crank-shaped in a direction different from that (up and down direction) in which the DTV antenna 41 extends.

The first loop antenna 30 mainly receives horizontally polarized waves, and the first monopole antenna 40 mainly receives vertically polarized waves. From this difference in operations, a current phase of a current flowing in the linear-wire-shaped ground part 44 of the first monopole antenna 40 differs from that of a current flowing in the right-and-left-direction antenna conductor of the adjacent DTV antenna 32, and thus interference between the first loop antenna 30 and the first monopole antenna 40 is suppressed.

The ground part 44 is formed into crank-shaped, in other words, into a meandering structure, and thus a current that flows in the ground part 44 is delayed by design. In other words, the current phase of the current flowing in the ground part 44 is made more different from that of the current that flows in the right-and-left-direction antenna conductor of the DTV antenna 32.

Thus, interference between the ground part 44 and the DTV antenna 32 can be reduced more, and thus reduction in a receiving performance of the first loop antenna 30 can be avoided more effectively. Moreover, a distance between the first monopole antenna 40 and the first loop antenna 30 can be more shortened, and thus an attachment area in the right and left direction can be more reduced as a result.

It is needless to say that, when a meandering structure is employed in the ground part 44, a mounted length of the ground part 44 can be shortened, and thus a mounted area of the first monopole antenna 40 itself can be reduced.

In FIG. 2A, a meandering structure is employed in the ground part 44 of the first monopole antenna 40. However, it is sufficient that a meandering structure is employed in at least a part of at least one of two adjacent antennas, and, for example, a meandering structure may be employed in the right-and-left-direction antenna conductor of the DTV antenna 32, this point will be mentioned later with reference to FIG. 5.

Next, the second integrated antenna 12 will be explained with reference to FIG. 2B. FIG. 2B is a diagram illustrating a configuration of the second integrated antenna 12 attached on a driver-seat side. As illustrated in FIG. 2B, the second integrated antenna 12 includes the second loop antenna 50 and the second monopole antenna 60.

First, an arrangement relation between the second loop antenna 50 and the second monopole antenna 60 will be explained. As illustrated in FIG. 2B, the second monopole antenna 60 is attached at a position closer to the right-side front pillar 3 than that at which the second loop antenna 50 is attached, and the second loop antenna 50 is attached at a position closer to the upper-center part of the front window 2 than that at which the second monopole antenna 60 is attached.

It is preferable that a distance between the second monopole antenna 60 and the front pillar 3 is ¼ wave length. Thus, the arrangement relation between the second loop antenna 50 and the second monopole antenna 60 is similar to the above arrangement relation between the first loop antenna 30 and the first monopole antenna 40, and similar effects can be obtained by this arrangement relation.

Figure 2B:
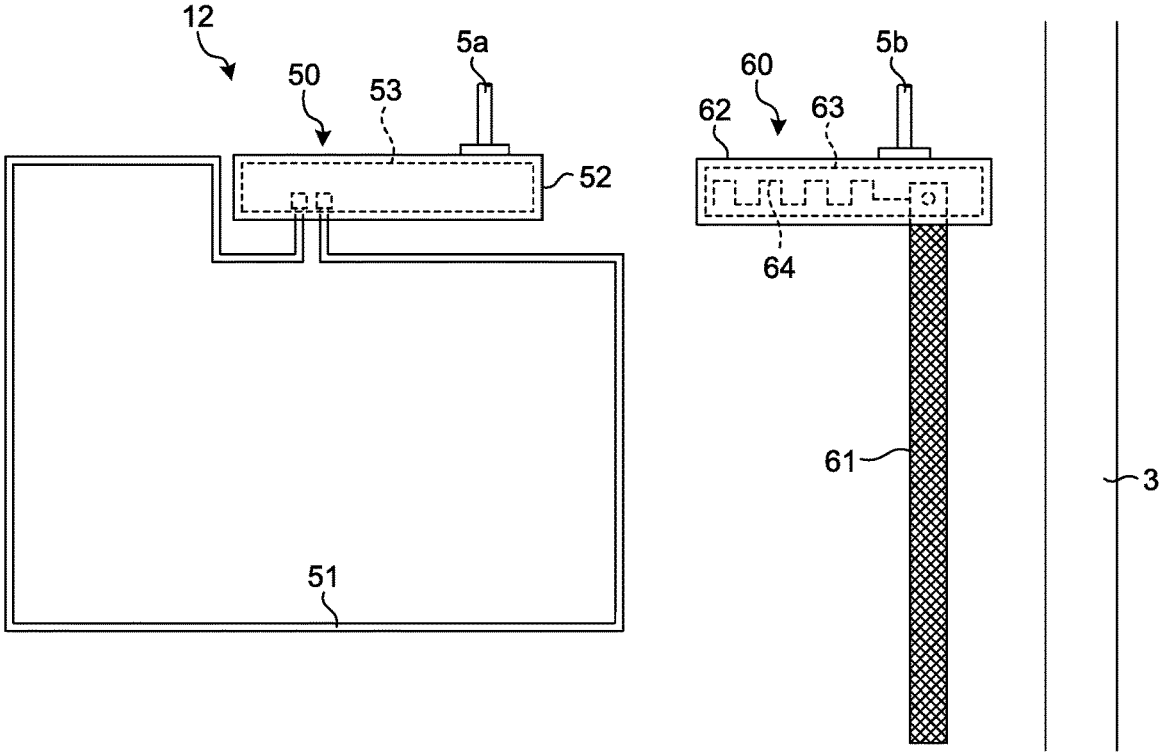
FIG. 2B is a diagram illustrating a configuration of a second integrated antenna attached on a driver-seat side.

Similarly to the above arrangements of the first loop antenna 30 and the first monopole antenna 40, arrangements of the second loop antenna 50 and the second monopole antenna 60 illustrated in FIG. 2B may be exchanged.

Next, configurations of the second loop antenna 50 and the second monopole antenna 60 will be explained. First, the second loop antenna 50 will be explained.

As illustrated in FIG. 2B, the second loop antenna 50 includes a DTV antenna 51 and a connector 52. Configurations of the DTV antenna 51 and the connector 52 are similar to the respective above configurations of the DTV antenna 32 and the connector 33 (see FIG. 2A). A configuration of a board 53 included in the connector 52 is similar to that of the board 34 included in the connector 33.

In other words, difference between the second loop antenna 50 and the first loop antenna 30 is presence and absence of the GPS antenna 31. In the present embodiment, the first loop antenna 30 on a front-passenger-seat side includes the GPS antenna 31. However, the second loop antenna 50 on a driver-seat side may include the GPS antenna.

An attachment area of the DTV antenna 51 of the second loop antenna 50 is equal to that of, for example, the DTV antenna 32 of the first loop antenna 30, not limited thereto, the attachment area of the DTV antenna 51 may be larger, for example.

Specifically, in the DTV antenna 51, a length of the antenna conductor in the right and left direction may be larger than that of the DTV antenna 32. This is because less other apparatuses are commonly attached to the front window 2 on a driver-seat side than on a front-passenger-seat side in consideration of hindrance to the field of forward view of a driver, and thus the DTV antenna 51 hardly has restriction on the attachment area.

Thus, a length of an antenna to be configured can be large, and a receiving performance of the DTV antenna 51 can be improved. Moreover, because the DTV antenna 51 is a transparent film, even when the attachment area of the DTV antenna 51 is enlarged, the field of view of the driver is not notably hindered.

Next, the second monopole antenna 60 will be explained. The second monopole antenna 60 has a configuration similar to that of the above first monopole antenna 40. Specifically, the second monopole antenna 60 includes a DTV antenna 61 and a connector 62. The DTV antenna 61 is similar to the DTV antenna 41 (see FIG. 2A, hereinafter, detailed explanation is omitted), the connector 62 is similar to the connector 42.

A board 63 and a ground part 64 included in the connector 62 are similar to the board 43 and the ground part 44, respectively. In other words, a conductive-wire pattern of the ground part 64 is formed into a meandering structure similarly to the ground part 44.

In FIGS. 2A and 2B, a case in which the antenna device 10 is attached to the front window 2 is explained. However, the antenna device 10 may be attached to a window of a rear window or one or more side windows.

For example, when the antenna device 10 is attached to a rear window, the first integrated antenna 11 is attached at a position that is approximately right back of a front-passenger seat and close to a rear pillar, and the second integrated antenna 12 is attached at a position that is approximately right back of a driver seat and close to a rear pillar.

For example, when the antenna device 10 is attached to side windows, the first integrated antenna 11 is attached on a door window on a front-passenger-seat side and at a position that is close to a side pillar, and the second integrated antenna 12 is attached on a door window on a driver-seat side and at a position that is close to a side pillar.

Figure 3:
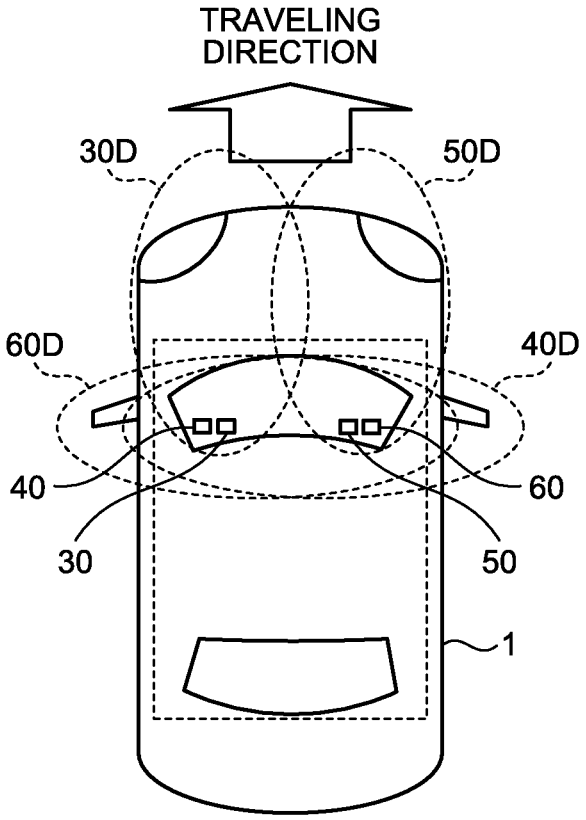
FIG. 3 is a diagram illustrating directionalities of the first and second integrated antennas.

Next, directionalities of the first integrated antenna 11 and the second integrated antenna 12 will be explained with reference to FIG. 3. FIG. 3 is a diagram illustrating directionalities of the first integrated antenna 11 and the second integrated antenna 12.

In FIG. 3, directionalities 30D, 40D, 50D, and 60D in a case of a top view of the vehicle 1 are illustrated by using dashed lines. The directionalities 30D, 40D, 50D, and 60D illustrated in FIG. 3 are one example that schematically indicates approximate directionalities, and not limited thereto.

As illustrated in FIG. 3, the first loop antenna 30 and the second loop antenna 50 respectively have the directionalities 30D and 50D whose directions are parallel to a traveling direction of the vehicle 1. The first monopole antenna 40 and the second monopole antenna 60 respectively have the directionalities 40D and 60D whose directions are perpendicular to the traveling direction of the vehicle 1, which is caused by interactions with the front pillars 3 of the vehicle 1.

Specifically, the front pillars 3 that are respectively close to the first monopole antenna 40 and the second monopole antenna 60 operate as reflectors, and thus the first monopole antenna 40 and the second monopole antenna 60 respectively have the directionality 40D and the directionality 60D each of whose directions is opposite to the corresponding front pillar 3.

For example, in the top view illustrated in FIG. 3, the first monopole antenna 40 has the directionality 40D toward the right direction that is opposite to the left-side front pillar 3 of the vehicle 1, and the second monopole antenna 60 has the directionality 60D toward the left direction that is opposite to the right-side front pillar 3.

Thus, in the antenna device 10 according to the embodiment, the first loop antenna 30 and the second loop antenna 50 can receive electric waves of horizontally polarized waves, and the first monopole antenna 40 and the second monopole antenna 60 can receive electric waves of vertically polarized waves.

Herein, with respect to each of the antennas, the interference between the antennas is reduced to the minimum by the above arrangement relation and the above meandering structure (see FIGS. 2A and 2B).

In other words, in the antenna device 10 according to the embodiment, the reduction of interferences of the antennas keeps independence of the antennas, and thus electric waves of both the horizontally and the vertically polarized waves can be received with high sensitivity.

Figure 4:
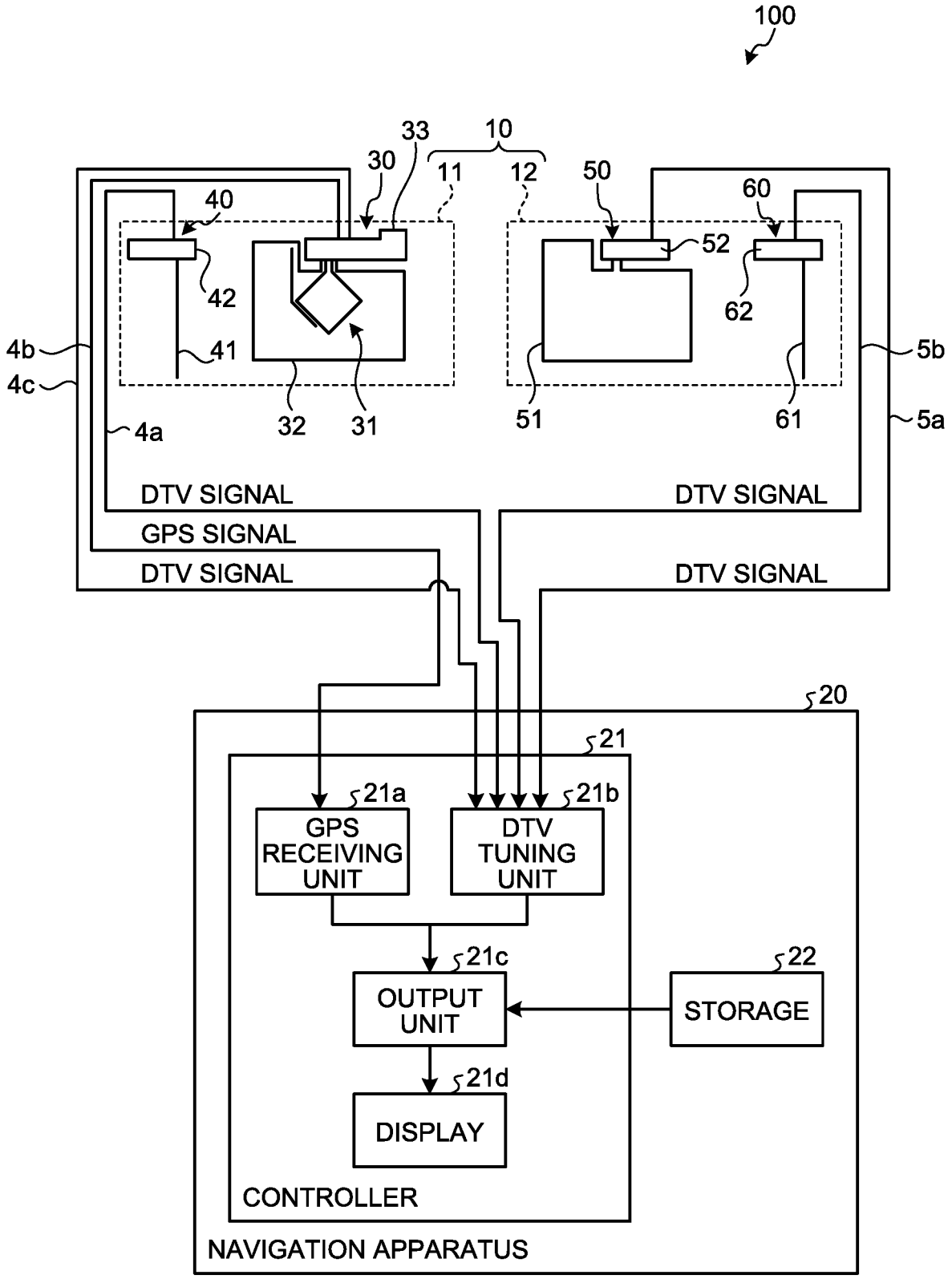
FIG. 4 is a block diagram illustrating a configuration of an antenna system including the antenna device according to the embodiment.

FIG. 4 is a block diagram illustrating a configuration of an antenna system 100 including the antenna device 10 according to the embodiment. As illustrated in FIG. 4, the antenna system 100 includes the antenna device 10 and the navigation apparatus 20.

The GPS antenna 31 receives electric waves from a GPS satellite. The electric waves received by the GPS antenna 31 are sent to the navigation apparatus 20 through the connector 33 and the cable 4*b*.

Each of the DTV antennas 32, 41, 51, and 61 receives electric waves of digital television broadcasting. The electric waves received by each of the DTV antennas 32, 41, 51, and 61 are sent to the navigation apparatus 20 as a DTV signal through the corresponding connector 33, 42, 52, or 62 and the corresponding cable 4*a*, 4*c*, 5*a*, or 5*b*.

The navigation apparatus 20 includes a controller 21 and a storage 22. The controller 21 includes a GPS receiving unit 21*a*, a DTV tuning unit 21*b*, an output unit 21*c*, and a display 21*d*.

Herein, the navigation apparatus 20 includes various circuits and a computer that includes, for example, a Central Processing Unit (CPU), a Read Only Memory (ROM), a Random Access Memory (RAM), a Hard Disk Drive (HDD), an input/output port, etc.

The CPU of the computer reads and executes, for example, a program stored in the ROM so as to function as the GPS receiving unit 21*a*, the DTV tuning unit 21*b*, the output unit 21*c*, and the display 21*d* of the controller 21.

At least one or all of the GPS receiving unit 21*a*, the DTV tuning unit 21*b*, the output unit 21*c*, and the display 21*d* of the controller 21 may be constituted of hardware such as an Application Specific Integrated Circuit (ASIC) and a Field Programmable Gate Array (FPGA).

The storage 22 corresponds to, for example, the RAM and the HDD. The RAM and the HDD can store programs and various kinds of information to be executed by the navigation apparatus 20. The navigation apparatus 20 may acquire the above programs and the above various kinds of information through another computer or a portable recording medium, which is connected by using a wired or a wireless network.

The controller 21 performs, in accordance with a display mode, signal processing on the electric waves received by each of the antennas, and further controls to display the processed waves on the display 21*d*. The GPS receiving unit 21*a* outputs the electric waves received by the GPS antenna 31 to the output unit 21*c* as a GPS signal.

The DTV tuning unit 21*b* performs diversity combination that combines DTV signals by using the four DTV signals received by the respective DTV antennas 32, 41, 51, and 61 so that a component of the DTV signal is included more as a reception state of this DTV signal is in a better condition.

Specifically, the DTV tuning unit 21*b* combines the DTV signals by the space diversity or the polarization diversity on the basis of the arrangements of the DTV antennas 32, 41, 51, and 61.

For example, when DTV signals of the DTV antennas 32 and 51, which are loop antennas, and the DTV antennas 41 and 61, which are monopole antennas, are used, the polarization diversity is performed, which combines horizontally polarized waves received by the loop antennas and vertically polarized waves received by the monopole antennas. When DTV signals of the DTV antennas 32 and 51, or the DTV antennas 41 and 61 are used, the space diversity is performed, which combines electric waves received by the antennas that are spatially separated.

In other words, when a diversity combination is performed by using DTV signals of two paired antennas that are adjacent to each other, the space diversity is switched into the polarization diversity. Thus, the diversity combination can be performed independent of a distance between the antennas to be able to shorten the distance between the antennas, so that it is possible to reduce the attachment area as a result.

When the navigation apparatus 20 is in, for example, a navigation mode, the output unit 21*c* computes a present position of the vehicle 1 on the basis of a GPS signal received by the GPS receiving unit 21*a*, and reads map information corresponding to the present position from the storage 22.

The output unit 21*c* causes the display 21*d* to display, for example, the read map information and a route to a destination. For example, a liquid crystal display may be used as the display 21*d*.

When the navigation apparatus 20 is in, for example, a television mode, the output unit 21*c* causes the display 21*d* to display digital television broadcasting on the basis of the DTV signal combined by the DTV tuning unit 21*b*.

As described above, the antenna device 10 according to the embodiment includes a plurality of plane-shaped antennas that is attached to one or more windows (for example, front window 2) of the vehicle 1. The plurality of antennas includes a loop antenna (first loop antenna 30 or second loop antenna 50) and a monopole antenna (first monopole antenna 40 or second monopole antenna 60) corresponding to this loop antenna. Thus, an attachment area can be reduced.

In the aforementioned embodiment, the first monopole antenna 40 and the ground part 64 of the second monopole antenna 60 have a meandering structure, not limited thereto, for example, antenna conductors in the right and left direction of the first loop antenna 30 and the second loop antenna 50 may have a meandering structure. In other words, it is sufficient that at least a part of at least one of the two adjacent antennas is formed into a meandering structure.

Alternatively, both of the loop antenna (first loop antenna 30 and/or second loop antenna 50) and the monopole antenna (first monopole antenna 40 and/or second monopole antenna 60) may have a meandering structure. This point will be explained with reference to FIG. 5.

Figure 5:
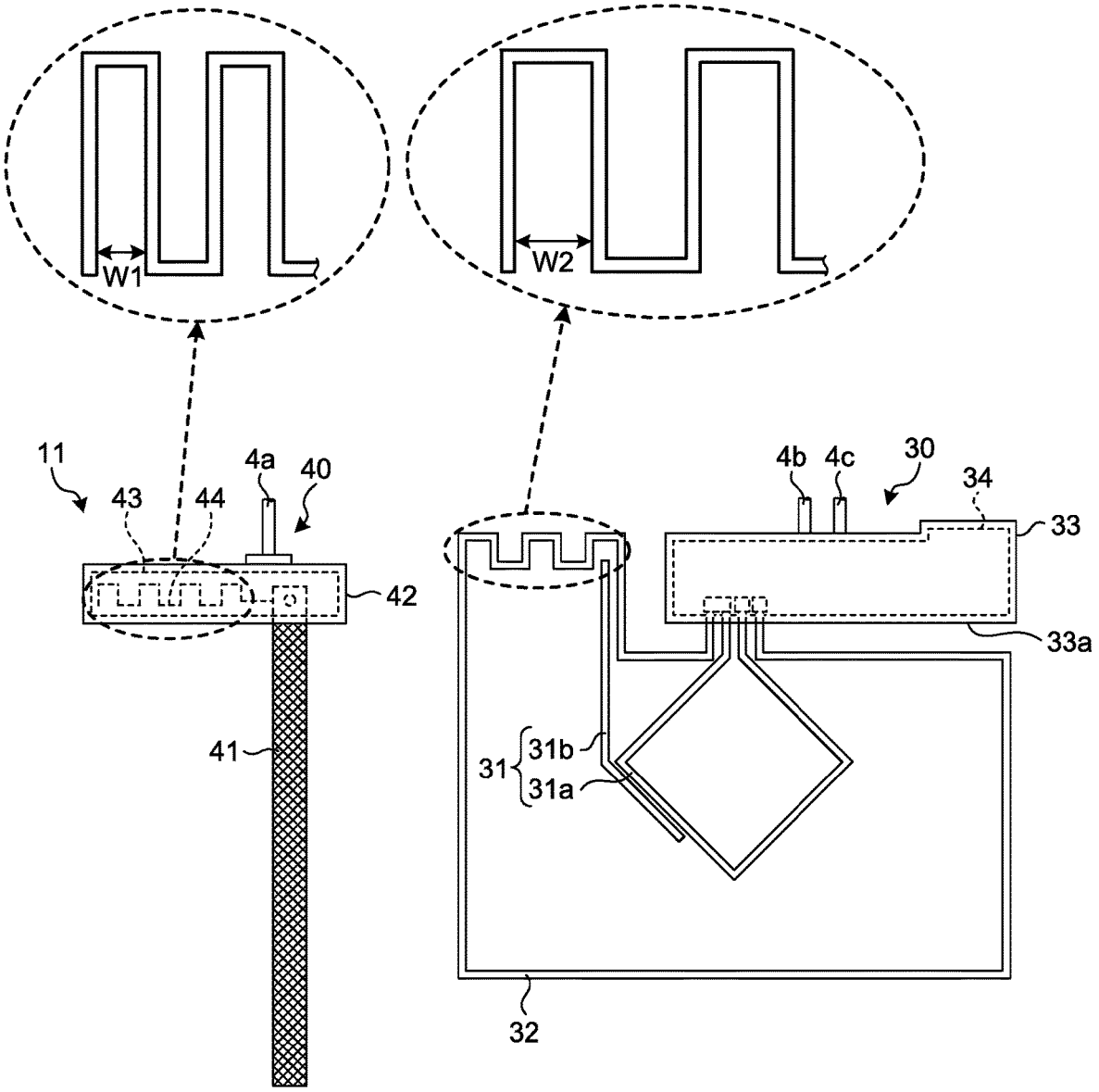
FIG. 5 is a diagram illustrating a configuration of a modified example of the first integrated antenna according to the embodiment.

FIG. 5 is a diagram illustrating a configuration of a modified example of the first integrated antenna 11 according to the embodiment. In FIG. 5, the same configuration as the aforementioned is provided with the same reference symbols, and duplicated explanation is omitted.

As illustrated in FIG. 5, the modified example of the first integrated antenna 11 according to the embodiment includes the first loop antenna 30 and the first monopole antenna 40 both of which have a meandering structure. Specifically, the ground part 44 of the first monopole antenna 40 and an antenna conductor in the right and left direction of the DTV antenna 32 of the first loop antenna 30 are formed into a meandering structure.

In this case, a width W2 of the meandering structure of the DTV antenna 32 is set to be longer than a width W1 of the meandering structure of the ground part 44. Thus, when the wavelengths of the antennas are set to be different from each other, difference between current phases of currents that respectively flow in both the antennas can be generated, and thus interference can be avoided, and the attachment area can be reduced more by shortening the distance between the antennas.

In FIG. 5, the width W2 is longer than the width W1. However, the width W2 may be shorter than the width W1. In other words, it is sufficient that the widths W1 and W2 differ from each other. As illustrated in FIG. 5, a side in an upward part of the DTV antenna 32 has a meandering structure. However, all of the sides in the upper part of the DTV antenna 32 may have a meandering structure. Alternatively, a side in the right and left direction in a lower part of the DTV antenna 32 may have a meandering structure.

In FIG. 5, a modification in the meandering structure of the first integrated antenna 11 is illustrated. However, the meandering structure of the second integrated antenna 12 may be similarly modified.

In the present embodiment, the antenna system 100 has a configuration including the navigation apparatus 20, not limited to the navigation apparatus 20, the antenna system 100 may include another on-vehicle communication apparatus.

According to an aspect of the embodiment, it is possible to reduce an attachment area, for example.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An antenna device for use with a vehicle, the antenna device comprising:

a plurality of plane-shaped antennas that is attached to one or more windows of the vehicle, the plurality of antennas including a set of:

(i) a loop antenna having a loop-shaped first antenna element, and (ii) a monopole antenna corresponding to the loop antenna, the monopole antenna having a pole-shaped second antenna element, wherein:

the first antenna element and the second antenna element of the set are arranged separately from and adjacent to each other, and at least a part of the loop antenna and the monopole antenna has a meandering structure extending in a first direction different from a second direction in which the second antenna element extends.

2. The antenna device according to claim 1, wherein a ground part of the monopole antenna is formed into the meandering structure.

3. The antenna device according to claim 1, wherein the monopole antenna is attached in a position that is closer to a pillar of the vehicle than that in which the loop antenna is attached.

4. The antenna device according to claim 2, wherein the monopole antenna is attached in a position that is closer to a pillar of the vehicle than that in which the loop antenna is attached.

5. The antenna device according to claim 1, wherein the plurality of antennas includes: one pair that includes the loop antenna and the monopole antenna; and another pair that includes a loop antenna and a monopole antenna corresponding to the loop antenna, the one pair is attached on a driver-seat side of the one or more windows, and the other pair is attached on a front-passenger-seat side of the one or more windows.

6. The antenna device according to claim 2, wherein the plurality of antennas includes: one pair that includes the loop antenna and the monopole antenna; and another pair that includes a loop antenna and a monopole antenna corresponding to the loop antenna, the one pair is attached on a driver-seat side of the one or more windows, and the other pair is attached on a front-passenger-seat side of the one or more windows.

7. The antenna device according to claim 3, wherein the plurality of antennas includes: one pair that includes the loop antenna and the monopole antenna; and another pair that includes a loop antenna and a monopole antenna corresponding to the loop antenna, the one pair is attached on a driver-seat side of the one or more windows, and the other pair is attached on a front-passenger-seat side of the one or more windows.

8. The antenna device according to claim 4, wherein the plurality of antennas includes: one pair that includes the loop antenna and the monopole antenna; and another pair that includes a loop antenna and a monopole antenna corresponding to the loop antenna, the one pair is attached on a driver-seat side of the one or more windows, and the other pair is attached on a front-passenger-seat side of the one or more windows.

9. The antenna device according to claim 1, wherein both of the loop antenna and the monopole antenna have the meandering structure.

10. The antenna device according to claim 9, wherein the meandering structure of the loop antenna has a first pitch in an extending direction of the meandering structure of the loop antenna, the meandering structure of the monopole antenna has a second pitch in an extending direction of the meandering structure of the monopole antenna, and a width of the first pitch and a width of the second pitch are different from each other.

* * * * *